US010188222B2

(12) United States Patent
Veron

(10) Patent No.: US 10,188,222 B2
(45) **Date of Patent: *Jan. 29, 2019**

(54) BED WITH EMBEDDED SMART SENSORS

(71) Applicant: Google Inc., Mountain View, CA (US)

(72) Inventor: Maxime Veron, Los Altos, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/494,937

(22) Filed: Apr. 24, 2017

(65) Prior Publication Data

US 2017/0224129 A1 Aug. 10, 2017

Related U.S. Application Data

(63) Continuation of application No. 14/585,220, filed on Dec. 30, 2014, now Pat. No. 9,629,475.

(51) Int. Cl.

| | |
|---|---|
| ***A47D 15/00*** | (2006.01) |
| ***A47D 9/00*** | (2006.01) |
| ***G08B 21/02*** | (2006.01) |
| ***G08B 17/10*** | (2006.01) |
| ***G08B 25/08*** | (2006.01) |

(52) U.S. Cl.

CPC ..... *A47D 15/00* (2013.01); *A47D 9/00* (2013.01); *G08B 17/10* (2013.01); *G08B 21/0205* (2013.01); *G08B 25/08* (2013.01)

(58) Field of Classification Search

CPC ... A47D 9/00; A47D 7/04; A47D 9/02; A47D 13/02; A61G 11/00; A61G 2200/14; A61G 2203/46; A61G 2203/30; A61G 2203/36; A61G 2203/42; A61G 2203/44; A61G 2203/70; A61G 2203/32; A61G 2203/38; A61G 2203/40

See application file for complete search history.

(56) References Cited

U.S. PATENT DOCUMENTS

| | | | | | |
|---|---|---|---|---|---|
| 3,658,052 | A * | 4/1972 | Alter | A61B 5/113 | 340/551 |
| 3,858,570 | A * | 1/1975 | Beld | A61G 11/00 | 392/416 |
| 4,350,166 | A * | 9/1982 | Mobarry | A61B 5/113 | 600/473 |
| 4,738,266 | A * | 4/1988 | Thatcher | A61B 5/0836 | 600/473 |
| 4,862,144 | A * | 8/1989 | Tao | A61B 5/113 | 340/573.1 |

(Continued)

*Primary Examiner* — Eric J Kurilla
(74) *Attorney, Agent, or Firm* — Morris & Kamlay LLP

(57) ABSTRACT

A smart crib is provided that includes a horizontal support platform and one or more vertical surfaces connected thereto that enclose a space above the horizontal support platform and/or define a space above the horizontal support platform. The horizontal support platform and/or the vertical surfaces may include one or more sensors that can be used to learn behavior of the crib occupant and/or determine conditions of the occupant and/or environment of the crib and/or the crib's surrounding area. The crib may receive responses from a client device and/or automatically act upon a detected condition in the crib or with the occupant.

23 Claims, 8 Drawing Sheets

(56) References Cited

U.S. PATENT DOCUMENTS 4,928,703 A * 5/1990 Wong ..... A61B 5/0873 600/473
5,037,375 A * 8/1991 Gatts ..... A61G 7/065 128/898
5,107,845 A * 4/1992 Guern ..... A61B 5/113 348/143
5,144,284 A * 9/1992 Hammett ..... A61B 5/1115 128/886
5,386,831 A * 2/1995 Gluck ..... A61B 5/01 600/474
5,453,077 A * 9/1995 Donnelly ..... A61G 11/00 600/22
5,551,109 A * 9/1996 Tingley ..... A47D 13/02 128/870
5,759,149 A * 6/1998 Goldberg ..... A61M 16/026 600/22
5,768,723 A 6/1998 Eckel
5,898,817 A * 4/1999 Salmon ..... A61G 11/002 108/145
5,912,624 A * 6/1999 Howard, II ..... G08B 21/02 340/521
5,914,660 A * 6/1999 Mesibov ..... G08B 21/0446 340/517
6,011,477 A * 1/2000 Teodorescu ..... A61B 5/113 340/573.1
6,043,741 A * 3/2000 Whitmarsh ..... A61G 3/06 340/522
6,082,693 A * 7/2000 Benson ..... A61G 11/00 248/281.11
6,113,455 A * 9/2000 Whelan ..... A63H 33/006 248/214
6,213,935 B1 * 4/2001 Mackin ..... A61G 11/00 600/22
6,433,699 B1 8/2002 Slomowitz et al.
6,513,164 B1 * 2/2003 Hearns ..... A41B 13/06 2/69.5
7,035,432 B2 * 4/2006 Szuba ..... A61B 5/1128 382/103
7,106,190 B1 * 9/2006 Owens ..... G08B 21/0446 200/61.45 R
7,357,772 B2 * 4/2008 McDermott ..... G16H 40/63 600/22
7,895,690 B2 * 3/2011 Kovalyak ..... A47D 15/008 5/655
8,316,482 B1 * 11/2012 Martin, III ..... A47C 29/00 5/655
2002/0143233 A1 * 10/2002 Donnelly ..... A61G 11/00 600/22
2002/0173696 A1 * 11/2002 Kolarovic ..... A61G 11/00 600/22
2003/0153805 A1 * 8/2003 Gryn ..... A61G 11/00 600/22
2003/0171065 A1 * 9/2003 Greenberg ..... A63H 33/006 446/226
2005/0094962 A1 * 5/2005 Elias ..... A63H 33/006 385/147
2006/0258916 A1 * 11/2006 Pietersen ..... A61B 5/0002 600/301
2008/0024311 A1 * 1/2008 Mann ..... A61B 5/11 340/573.1
2009/0031495 A1 * 2/2009 Wang ..... A47D 13/105 5/108
2009/0062622 A1 * 3/2009 Lin ..... A47D 9/02 600/300
2009/0070929 A1 3/2009 Holman
2009/0131185 A1 * 5/2009 Speedie ..... A47D 9/02 472/119
2010/0125949 A1 * 5/2010 Stebbing ..... A47C 21/044 5/423
2012/0062735 A1 3/2012 Rivera
2013/0254989 A1 * 10/2013 Garcia ..... A47C 21/046 5/421
2014/0060546 A1 * 3/2014 Pino ..... A61B 5/6887 128/845
2014/0075671 A1 * 3/2014 Haut ..... A47D 9/02 5/109
2014/0106891 A1 * 4/2014 Pyrce ..... A47D 13/105 472/119
2014/0266669 A1 9/2014 Fadell et al.
2014/0275742 A1 * 9/2014 Andrew ..... A61M 21/02 600/28
2014/0296947 A1 * 10/2014 Timme ..... A61G 11/00 607/96
2014/0303694 A1 * 10/2014 Timme ..... A61M 16/024 607/96
2015/0009029 A1 1/2015 Martin
2015/0022343 A1 1/2015 Sanders
2015/0045608 A1 * 2/2015 Karp ..... A47D 15/008 600/28
2015/0105608 A1 * 4/2015 Lipoma et al. ..... A61B 5/6896 600/27
2015/0182406 A1 * 7/2015 Falk ..... A61G 11/00 600/22
2015/0276239 A1 10/2015 Fadell et al.
2015/0302721 A1 10/2015 Schmidt
2015/0342281 A1 * 12/2015 de la Fuente ..... A42B 3/046 340/573.1
2016/0074260 A1 * 3/2016 Belsinger, Jr. ..... A61B 8/06 600/509

* cited by examiner

BED WITH EMBEDDED SMART SENSORS

BACKGROUND

Baby cribs are routinely purchased on the basis of safety and aesthetic features. Typically a mattress for the crib is separately purchased for similar reasons. Many users separately select a baby monitor that includes a camera and/or microphone. More sophisticated monitors may have an infrared camera and/or a speaker. The monitor may include a camera that can be placed in a position that overlooks the baby crib. In some configurations, the camera and/or microphone may be affixed to the crib using child proof and safe mechanism. The baby monitor may contain a controller (e.g., head unit) to which the signal from the camera and/or speakers is transmitted. The head unit may contain indicators for the volume of sound detected by the microphone. The head unit may contain various buttons that activate or deactivate the display and/or speakers on the head unit. Thus, a baby monitor may be retrofitted to a baby crib.

BRIEF SUMMARY

According to an implementation of the disclosed subject matter, a baby crib is disclosed that includes a horizontal support platform and a base structure disposed below and physically supporting the horizontal support platform. The crib may include one or more vertical surfaces connected to the horizontal support platform and arranged to form a contained area at least 50 cm above the horizontal support platform. A first sensor may be physically integrated with the horizontal support platform and a second sensor may be physically integrated with the vertical surfaces.

In an implementation, a state of an environment in which a baby crib is located may be detected. The environment may include an environment within and surrounding the baby crib and a state of an occupant. The state of the environment may be determined to be unsatisfactory based on a preconfigured set of states. A notice may be generated in response to the determined unsatisfactory environment. The notice may be dispatched to a client device associated with the baby crib. A response from the client device may be received. The response may indicate an action to be taken by an entertainment device. The action may be determined to have resolved the unsatisfactory state.

A child crib is disclosed that includes a first sensor integral with a horizontal support platform of the crib and a second sensor integral with a portion of an enclosure of the crib. The child crib may include a wireless communication module and a processor. The processor may be configured to determine a condition of an occupant of the crib based upon data received from the first sensor, the second sensor, or both, and to provide an indication of the condition to a remote device.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

As disclosed herein, one or more sensors may be integrated into a crib or toddler bed. The sensors, by virtue of being integrated into the crib, may be noninvasive and require no physical set-up by the user. Further, because the sensors are integrated into the crib, they mitigate the risks involved in placing foreign objects near and/or in a baby crib. The sensors may provide a desired monitoring of the baby crib without requiring separate wiring (e.g., power supply) and/or configuration. Each sensor may be modular. For example, each sensor may be a predetermined size and shape that matches a cavity or other attachment point in a portion of the crib, such as a horizontal support platform on which a mattress may be placed. Each sensor module may contain an identical connection system that provides it with power. The modular design of the sensors may permit a user to interchange one sensor with another sensor. The sensors may communicate with one another and/or with other devices, such as a smart home network or associated devices, to generate a notice based upon the combined data from the different sensors.

Figure 1A:
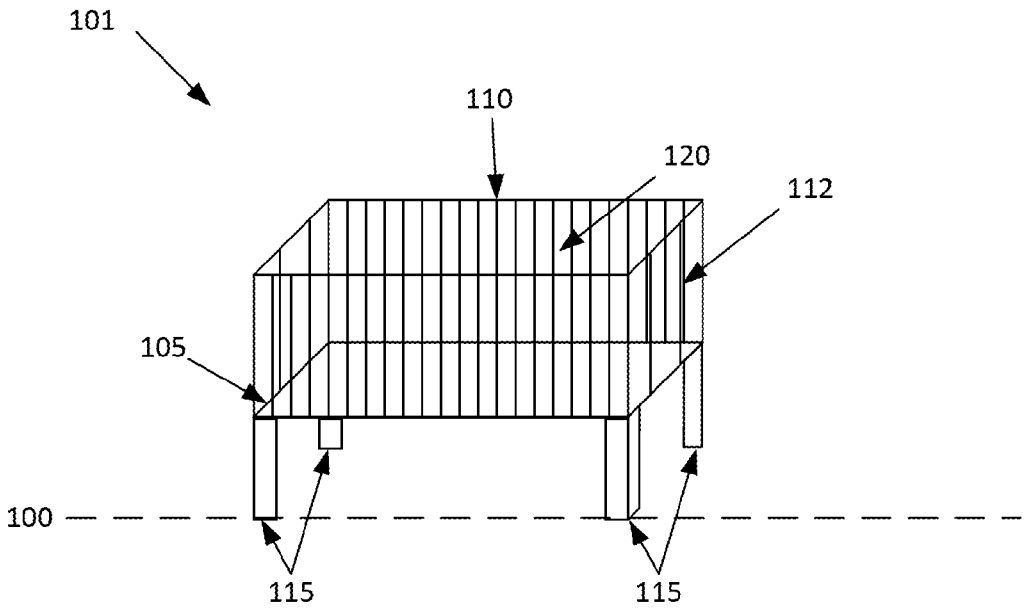
FIG. 1A is an example of a baby crib according to implementations disclosed herein.

FIG. 1A is an example of a baby crib 101 according to implementations disclosed herein. The crib 101 may include a horizontal support platform 105, one or more vertical surfaces 110, 112, and/or a base structure 115. The horizontal support platform 105 may be substantially parallel to a floor 100. In many configurations, the horizontal support platform 105 may be rectangular in shape. The horizontal support platform 105 may be inclined at an angle of 10 degrees or less relative to the floor 100. In some cribs, an inclined platform 105 may be useful to elevate an infant's or toddler's head. The degree of inclination may be configured by a user. For example, a short end of the rectangular horizontal support platform 105 may be affixed to other components of the crib (e.g., the base structure 115 and/or one or more of the vertical surfaces 110, 112) higher than an opposite short end of the horizontal support platform 105. In some configurations, the elevation of an end of the horizontal support platform 105 may be controlled by a motorized mechanism. In some configurations, the depth of the contained area 120 created by the horizontal support platform 105 and the vertical surfaces 110, 112 may be adjusted by raising and/or lowering the height of the horizontal support platform 105. That is, the height of the horizontal support platform 105 relative to the floor 100 (e.g., distance between the platform 105 and the floor 100) may be adjusted manually (e.g., by adjusting the mounting location of the horizontal support platform 105 on the one or more vertical surfaces) or by a motorized mechanism.

The horizontal support platform 105 may be constructed from a variety of materials such as a metal alloy, wood, plastic, a composite material, or any other suitable materials. The crib 101 materials and design may be configured to support between 10 kg to 35 kg. The dimensions of a rectangular horizontal support platform 105 may be between 60 cm and 150 cm for the short ends and 90 cm to 180 cm for the long ends. While these dimensions may accommodate most standard-sized crib mattresses, other sizes may be compatible with the implementations disclosed herein. In addition, the horizontal support platform 105 may be constructed in other shapes, such as circular, octagonal, or hexagonal, in accordance with any of the implementations disclosed herein. Description regarding the shape of the baby crib 101, materials to construct the crib 101, and/or the dimensions of the crib 101, are merely for reference and are non-limiting. Further, implementations are described in terms of a baby or toddler crib, however other furniture such as a full size bed may be used according to the implementations disclosed herein.

The horizontal support platform 105, as shown in FIG. 1A, may be a solid slab with one or more sensors embedded therein. The horizontal support platform may include one or more cavities into which a mounting screw or bolt may be attached. In some configurations, the crib 101 may utilize one or more slots to mount to the base structure 115 and/or the one or more vertical surfaces 110, 112.

Figure 1B:
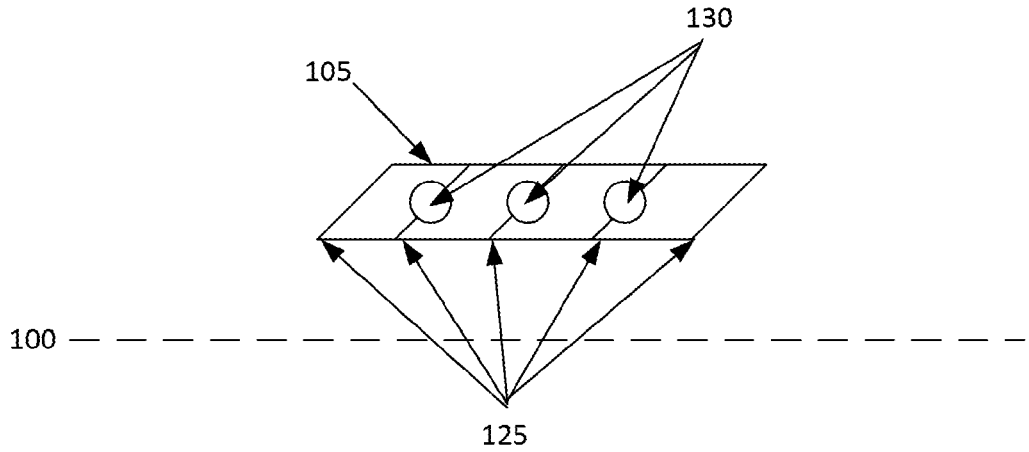
FIG. 1B is an example configuration of the horizontal support platform in which it includes one or more springs and one or more sensors connected thereto as disclosed herein.

FIG. 1B is an example configuration of the horizontal support platform 105 in which it includes one or more springs 125 and one or more sensors 130 connected thereto. As described above, the sensors 130 may be modular in some configurations to allow an end user to easily swap or replace sensors. The one or more sensors that are present in the horizontal support platform 105 will be described further below. The horizontal support platform 105 may be a slab and a pressure sensor may be embedded therein. For example, the pressure sensor may be a capacitive, electromagnetic, and/or piezoelectric pressure sensor. Such a slab design may be utilized to determine the location of the pressure detected relative to horizontal support platform 105. A slab design with an integrated pressure sensing mechanism or multiple pressure sensors may detect multiple points of pressure on the first surface and/or the location thereof relative to the position of the horizontal support platform 105. For example, the pressure sensor may determine that a baby is located at one end of the crib and sleeping parallel to one of the short edges of a rectangular horizontal support platform 105. A pressure sensor may be sufficiently sensitive to detect such pressure variation even with a mattress, sheets, etc. on top of the first surface 105. Thus, a first sensor may be physically integrated into the horizontal support platform.

The first surface 105 may be supported by a base structure 115. The base structure 115 may be disposed below and physically supporting the horizontal support platform 105. The base structure 115 may refer to the portion of the crib frame 101 that contacts the floor 100 and the horizontal support platform 105. In some configurations, the base structure 115 may be composed of multiple components. The base structure 115 may be part of the vertical surfaces 110, 112 that surround and extend above the horizontal support platform 105. The base structure 115 may be posts located at each corner of the crib as shown in FIG. 1A. In some configurations, the base structure 115 may be incorporated into the horizontal support platform 105. For example, the horizontal support platform 105 may have four posts that attach to it and provide a base of support for the entire crib 101.

The crib 101 may be assembled using a variety of methods known to those of ordinary skill in the art. A non-exhaustive list of assembly mechanisms for the various components of the crib 101 includes fasteners, clips, dowels, screws, bolts, Velcro, etc. For example, a vertical surface 110, 112 may be attached to another vertical surface 110, 112 and/or the horizontal support platform 105 using bolts secured with washers and a nut.

Figure 2A:
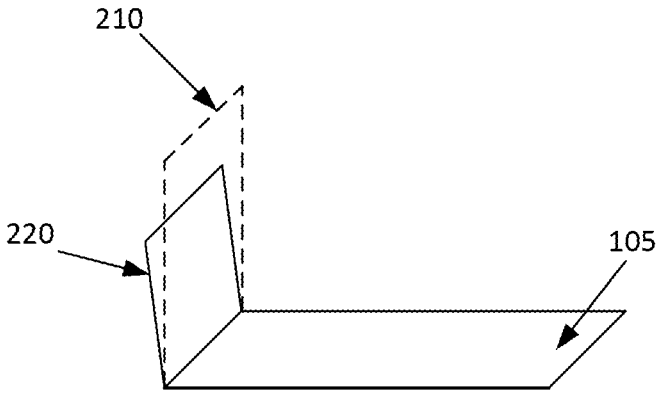
FIG. 2A shows an example of a substantially orthogonal vertical surface as disclosed herein.

The crib 101 may contain one or more vertical surfaces 110, 112. The vertical surfaces 110, 112 may be substantially orthogonal to the horizontal support platform as shown in FIG. 1A. FIG. 2A shows an example of a substantially orthogonal surface. The dashed line indicates an imaginary plane 210 that is orthogonal to the horizontal support platform 105. Substantially orthogonal may refer to a position that is 30 degrees or less outward or inward relative to the imaginary plane 210, extending upwards from the horizontal support platform 105. In FIG. 2A, a vertical surface 110 for the short end of the crib 101 is angled outward relative to the imaginary plane 210. One of the longer vertical surfaces 112 may be similarly angled outward. Thus, one or more of the vertical surfaces 110, 112 may be angled outward and/or inward relative to an imaginary plane that is orthogonal to the horizontal support platform 105.

Figure 2B:
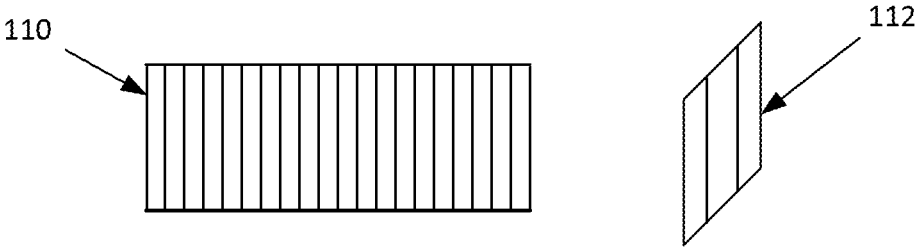
FIG. 2B is an example of the two vertical surfaces that are dissimilar in their shape and/or size as disclosed herein.

In general, the crib 101 may contain four vertical surfaces 110, 112 as shown in FIG. 1A. One or more of the vertical surfaces 110, 112 may extend 50 cm or more above the horizontal support platform as depicted in FIG. 1A. The height of the vertical surfaces 110, 112 may be adjustable. For example, as a child ages, it may not be necessary to have the entire crib enclosed by the vertical surfaces 110, 112. A vertical surface 110, 112 does not need to be identical in size or shape to another vertical surface 110, 112 as illustrated in FIG. 2B. Similarly, one of the vertical surfaces 110, 112 may be elongated relative to the other vertical surfaces 110, 112 present. The region bounded by the vertical surfaces 110, 112 and above the horizontal support platform 105 may define a contained area 120 into which a baby or toddler may be placed (e.g., on a mattress that sits atop the horizontal support platform 105).

The crib 101 may be utilized for a toddler in some configurations. For example, the crib 101 may have an opening that would allow easy ingress and egress into the contained area 120 above the horizontal support platform 105 and bounded by the vertical surfaces 110, 112. The vertical surfaces 110, 112 other than the one with the opening may extend above the horizontal support platform by 50 cm or more.

In some configurations, one of the vertical surfaces may be configured to have an opening that can be latched/unlatched electronically in response to a signal received form a client device and/or a controller as described below with which the crib is in communication. For example, the crib may have physical integrated sensors that, in response to an environmental condition (e.g., high carbon monoxide concentration, fire, etc.) automatically open the crib. As another example, the crib sensors may indicate that the child is awake and send an indication thereof to a client device (e.g., smartphone or smart watch).

Figure 3:
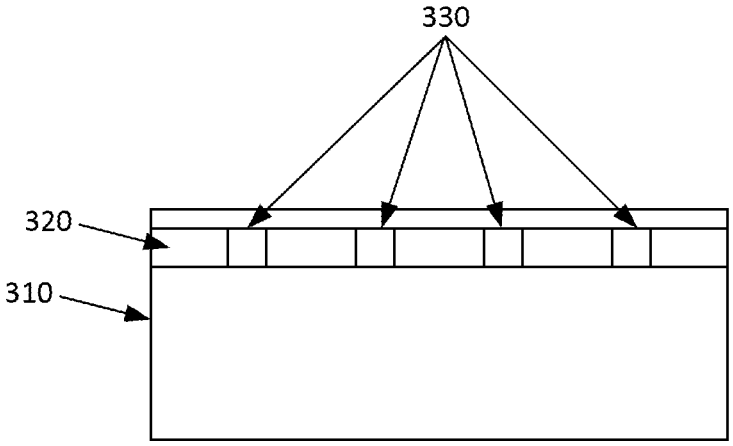
FIG. 3 shows an example of sensors integrated into a vertical surface as disclosed herein.

One or more of the vertical surfaces may include one or more second sensors. FIG. 3 shows an example of sensors 330 physically integrated into a vertical surface 310. Each vertical surface may be similarly configured as shown in FIG. 3 or utilize a unique configuration of sensors 330 (including having no sensors). The sensors 330 may be integrated into a "sensor bar" 320. The sensor bar 320 may provide power and/or communications channels for the sensors 330. For example, the sensor bar 320 may allow for a magnetic power connection and data exchange between the bar and the sensors 330. The sensors 320 may be connected to the vertical surface 310 by a variety of methods know to those of ordinary skill in the art. The sensors may be secured and/or fastened/affixed to the vertical surface 310 using any known childproof or—safe technique or combination thereof.

In some configurations, the vertical surface 310 may not utilize a sensor bar as shown in FIG. 3. Instead, each sensor may have a pre-fabricated position. The vertical surface 310 may have internal cable routing such as for power and/or communication (e.g., Ethernet cable). It will be understood by a person of ordinary skill that although FIG. 3 depicts the sensors 310 in a row and evenly spaced, the position and orientation of the sensors may be varied as necessitated by design of the crib, safety concerns, aesthetics, function of the sensor (e.g., a camera sensor would most likely be positioned to have an overhead view of the contained area 120), and/or individual preference of the crib designer. As stated above, each sensor 330 may be modular such that any one of the four sensors 330 shown in FIG. 3 may be swapped with any other of the sensors 330.

A first sensor and/or a second sensor may include one or more of: a camera, a pressure sensor, a microphone, a light sensor, an air sensor, a temperature sensor, an accelerometer, a humidity sensor, etc. Additional description regarding sensor systems is provided below in reference to FIGS. 7A-7C in reference to a smart home and/or home security system, of which the crib disclosed herein and sensors embedded therein may be a part. In some configurations, multiple cameras may be utilized, each of which provides a different viewing angle of the interior space of the crib (e.g., the cavity 120 shown in FIG. 1A). The camera may be an infrared camera to provide nighttime or dark vision (e.g., passive infrared or "PIR").

Figure 4:
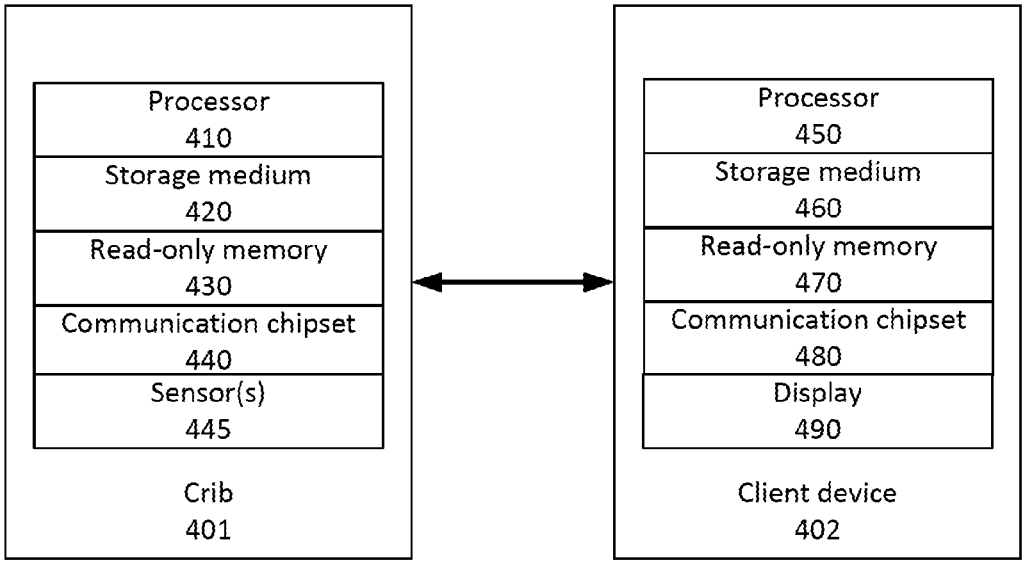
FIG. 4 is an example configuration of hardware that may be utilized to communicate sensor data, instructions, and/or notices between the crib and a client device, a controller, and a remote system as disclosed herein.

FIG. 4 is an example configuration of hardware that may be utilized to communicate sensor data, instructions, and/or notices between the crib and a client device, a controller, and a remote system. FIG. 4 shows the crib 401 having a communication chipset 440. A communication device or chipset 440 may be included and/or physically integrated into the crib 401 (e.g., in the first surface, a second surface, and/or a base structure). The communication device 440 may be a wired connection capability such as Ethernet and/or a wireless connection such as Wi-Fi, Bluetooth (including low-energy Bluetooth), near field communication ("NFC"), a radio antenna, or the like. The communication device 440 may be configured to communicate with the communication chipset 480, one or more client devices 402, a controller, and/or a remote system. A client device 402 may refer to a smartphone, tablet, personal computer (laptop, desktop), etc. The client device 402 may contain a display 490, microphone, and one or more speakers. Each sensor 445 in the crib 401 may generate data that may be stored on a local storage medium 420 (e.g., FLASH, NAND, or solid state drive) or a remote storage medium (e.g., a cloud service or the client device 402). The crib 401 may include a processor 410 that may utilize instructions stored on read only memory 430 to provide for basic interoperability between the sensors 445 and communication chipset 440. The crib 401 may contain more than one of any particular type of sensor 445. For example, the crib 401 may contain multiple cameras.

The client device 402 may include a processor 450, storage medium 460, and read only memory 470. The client device 402 processor 450 may receive the data provided by the crib 401 and/or send data/instructions to the crib 401 via the communication chipset 480. The communication between the crib 401 and the client device 402 may occur indirectly and/or directly. For example, a remote system such as a cloud service may relay communication between the crib 401 and the client device 402. In some instances, the remote service may perform processing of the data sent by the crib 401 and provide the processed data to the client device 402. For example, the crib 401 may analyze the sleeping pattern of the child based on a motion sensor 445. It may, based on the amount of motion detected within a time interval, send a notice to the client device 402.

The communication device 440 and/or power connection between the crib 401 and/or the sensors 445 may be shielded from the intrusion of electromagnetic radiation (e.g., radio frequency electromagnetic radiation) into the contained area occupied by an infant. The shielding may extend over a portion of the horizontal support platform and/or one or more of the vertical surfaces. Typically, the shielding may be applied to cables to isolate wires from the environment. The shielding may be applied to enclosures for any sensors integrated into the crib. For example, a copper and/or nickel spray may be applied to the interior of plastic enclosures for the sensors, processor, and/or communication device.

Processing of the data may be performed in at least three different ways. In an implementation, the crib contains a processor physically integrated in the horizontal support platform and/or one or more of the vertical surfaces. In some configurations, the data generated by the sensors may be sent to a cloud service that may store and/or perform the processing of the data. In some configurations, the data generated by the sensors may be sent to a client device for processing. Whether the processor is a component of the crib or is remote, it may be configured to respond to the data generated by the sensors in the horizontal support platform and/or vertical surfaces (See FIG. 1A). Description below and above referencing a processor may refer to one or more of a processor in the crib, a processor of the client device, a processor associated with a remote system and/or a controller.

As an example, one of the sensors in the horizontal support platform may be a pressure sensor. The pressure sensor may be, for example, a capacitive pressure sensor, an electromagnetic pressure sensor, and/or a piezoelectric pressure sensor. A top side of the horizontal support platform 105 may be used to detect pressure exerted on the horizontal support platform 105. The top side of the horizontal support platform 105 may refer to the side of the horizontal support platform 105 opposite the floor 100 (e.g., not facing the floor 100) as shown in FIGS. 1A and 1B. A bottom side of the horizontal support platform 105 may refer to the side of the horizontal support platform 105 that faces the floor 100. In some configurations, a combination of pressure sensors (e.g., an array) may determine the location of the pressure relative to horizontal support platform 105. For example, a pressure sensor may detect that there are two distinct and localized areas of pressure, suggesting that a child is standing in the crib. Conversely, it may detect that there is pressure across a relatively broad area of the horizontal support platform 105, indicating that the child is laying down. The pressure sensor may detect the direction a child is laying in the crib or position of a child in the crib based on the distribution of the pressure on the horizontal support platform. The pressure sensor, despite being covered by a mattress, may be capable of detecting a heartbeat depending on the type and sensitivity of the pressure sensor employed.

In some instances, the processor may utilize data generated by multiple sensors to detect a particular behavior by a child/occupant of the crib 101. For example, the pressure sensor data described above may be combined with a motion detecting camera (e.g., infrared camera). The combination of the data may indicate when the child is awake (e.g., where motion and two distinct pressure points are detected) versus sleeping poorly (e.g., motion detected and a relatively broad area of pressure detected). The motion sensor and pressure sensor may further be augmented by microphone data that indicates whether the child is speaking (e.g., crying) or not, the latter being associated with needing attention from an adult.

The processor may be configured to generate a notice based on the sensor data generated by one or more sensors in the crib. If the processor is physically integrated into the crib or is a part of a controller (e.g., for a smart home) and/or a cloud service, the processor may transmit the notice to the client device via the communication device (e.g., over wireless internet) as described above in reference to FIG. 4. If the processor is a part of the client device, then the notice may be generated thereon. The notice may be presented visually or aurally (as described below).

The crib may contain an entertainment device. As with the sensors, an entertainment device may be modular and interchangeable with a sensor as far as position on the crib. In some configurations, the position of the entertainment device may be fixed with respect to the crib. A non-limiting list of an entertainment device may include a projector (e.g., a nano projector), a speaker, and a LED. An entertainment device may be an interactive device. For example, the crib may have a series of differently shaped pads that can illuminate in different colors. When the child touches a shape, it may flash and/or emit a sound through a speaker. More than one entertainment device may be present in the crib. For example, each corner of a baby crib may contain a speaker and/or microphone. Further, the entertainment device may be combined with a sensor. For example, a LED may be combined with a camera sensor in a single module or at the same location in the crib. The LED may be illuminated at a dim level to allow a parent, for example, to visualize a child through the camera.

As an example, a processor may be configured to detect an occupant condition based on data generated by the one or more sensors present in the crib. An occupant condition may refer to, for example, a child being awake (e.g., based on motion sensor and pressure sensor data), crying (e.g., based on a microphone), a noxious compound such as carbon monoxide (e.g., based on an air sensor), a dirty diaper (e.g., based on air sensor), an illness (e.g., vomit detected by air sensor), heart palpitations detected (e.g., by pressure sensor), unusual lack of movement (e.g., based on a motion sensor), an unusual by temperature (e.g., by a temperature sensor and/or a thermal imaging camera), coughing or sneezing (e.g., by motion capture camera and/or a microphone), etc. An air sensor, as used herein, may refer to a device capable of detecting a volatile organic compound or providing an air quality indication. For example, an air sensor may measure the amount or percentage of carbon monoxide or carbon dioxide in the air. An air sensor may detect the presence or percentage of methane gas present in the air. One or more air sensors may be utilized with the baby crib disclosed herein.

A response may be generated based on the condition detected by the sensors. The response may be emitted through an entertainment device. For example, if the child is crying, the projector may activate and display some cartoon animals on the ceiling. The projection may be accompanied by music played at a volume that is determined based on the ambient level of sound detected in the room by the microphone and/or the time of day. The response that is generated to the occupant condition may be configured by the end user. For example, the user may be presented with the option of having the crib not respond to a child's cry when the crying is detected for at least 30 seconds and, instead, notify the user's client device in those situations. The user may elect to have music played if the child is crying for at least a 20-second interval. By preconfiguring responses to be performed by the crib, the responses can occur without further user interaction. That is, the client device belonging to a parent of the child may not need to be disturbed with a notice.

In some instances, however, the crib may be configured to detect an occupant condition and communicate the condition detected to a client device, and/or other devices, such as other devices that are in a common smart home network with the crib. As described above, the detection of the condition may be performed by a processor that is physically integrated into the crib, a client device, a part of a controller and/or remote system such as a cloud service. A processor in the crib may transmit a notice regarding the determined occupant condition to the client device (e.g., child crying) using the communication device to send the notice regarding the occupant condition. In some configurations, the cloud service may send a notice regarding the occupant condition that has been determined by the cloud service determined based on the sensor data provided by the crib via the communication device. The client device may alert the user of the notice or as a component of the notice the user may be alerted of the occupant condition. For example, in the event the child is crying, an alarm may be emitted on the client device based on the notice received. The notice may indicate, for example, "Child crying for greater than 20 seconds." A user may select from available options or capabilities of the crib regarding how to proceed. For example, the user may elect to have the crib play music, play a pre-recorded sound (e.g., the mother's voice), and/or project an image and/or video. The processor may be configured to receive the instruction sent by the client device and generate a response that is emitted through the entertainment device. For example, the instruction from the client device may be to play a video. The response generated may include the location of the video resource (e.g., on the Internet or locally) and the entertainment device that is to handle the instruction (a projector in this example).

Figure 5:
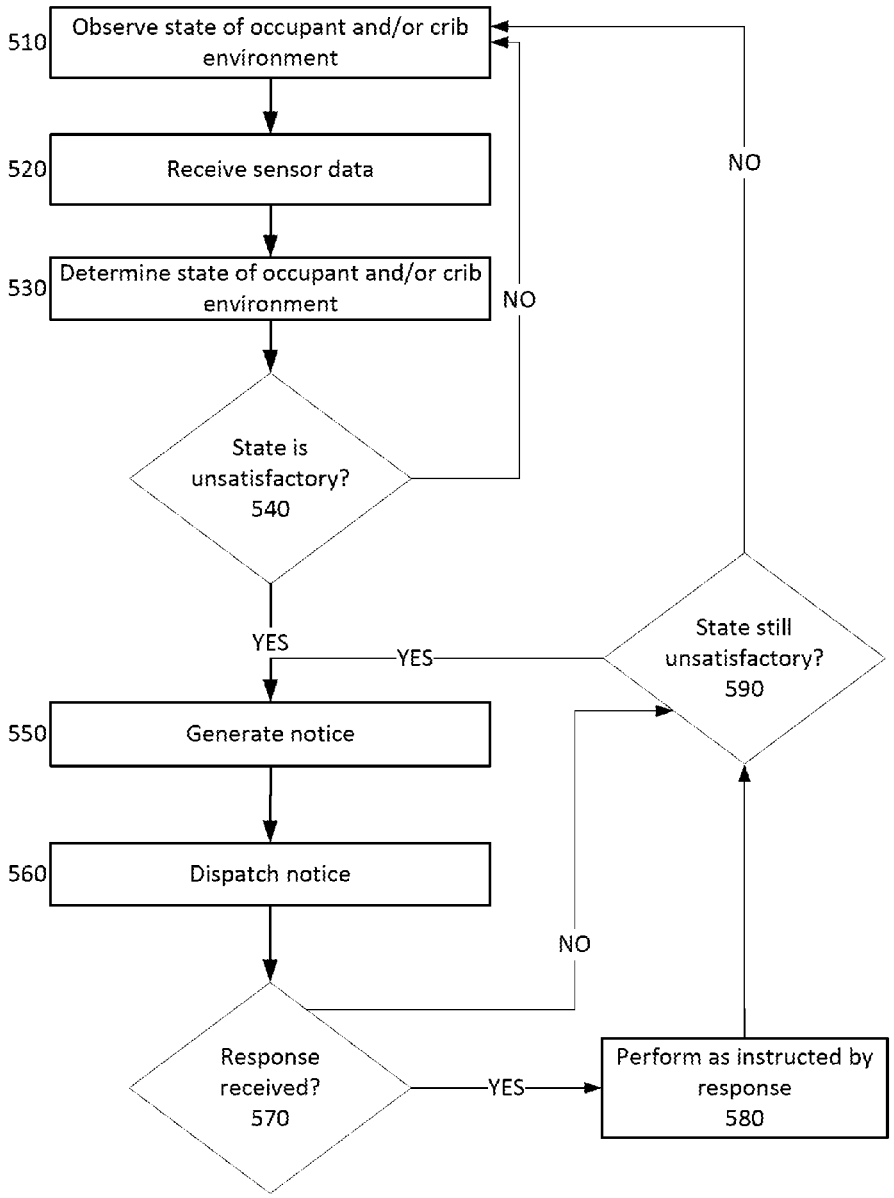
FIG. 5 is an example process for notifying a client device and receiving a response therefrom as disclosed herein.

FIG. 5 is an example process for notifying a client device and receiving a response therefrom as disclosed herein. Beginning at 510, the state of the occupant and/or the environment in which the baby crib is located may be observed using one or more sensors associated with the crib. The sensor data may be received and/or stored by a database and/or computer readable memory 520. A processor with access to the data may be configured to determine a state of the occupant and/or the crib environment based on the obtained sensor data at 530. In some instances, the processor may have access to other sensors that are not connected with crib. For example, as part of a home security system, a motion sensor may be in the room in which the crib is located (but not connected to the crib). The motion data from the sensor may be combined in the determination of the environment state and/or the occupant state at 530.

The processor may determine whether the state of the occupant and/or environment is unsatisfactory at 540. An unsatisfactory state may refer to preconfigured states and/or user-configured states that are undesirable. For example, a temperature sensor and a thermal camera may indicate that there is an unusually strong heat source near the crib (e.g., a fire). Another example of an undesirable state may be crying by the occupant for more than 20 seconds at a volume in excess of 55 dB. As another example of an undesirable state, a volatile organic compound may be detected by an air sensor (e.g., methane percentage in excess of a threshold level). In some configurations, the undesirable state may be based upon a learned behavior of the environment and/or the occupant. For example, the occupant may have a sleeping behavior or pattern that is learned by the crib and/or an associated smart home network. If the processor determines, based on the motion sensor and pressure sensor, that the child is awake at a time when the learned behavior is for the child to be asleep, it may be an undesirable state. As another example, the lights in the room in which the crib is located may be part of a smart home system. A light sensor may indicate that the light level is at an undesirable level for the time of day based on the learned behavior for that particular room of the house.

If the state is determined to satisfactory at 540, then the system may continue to observe the environment and/or occupant as shown at 510. If the state is determined to be unsatisfactory at 540, then the processor may generate a notice at 550 that can be dispatched to a client device and/or a controller at 560. The processor may determine, at 570 that no response has been received after a threshold amount of time (e.g., 2 minutes). In that case, it may determine if the condition is still unsatisfactory at 590. If the condition is now satisfactory based on the new sensor data, then the system may return to 510. If the condition is still unsatisfactory, the system may again generate and dispatch a notice at 550, 560. If a response has been received, for example from a client device, then the system may perform the action instructed by the response at 580. It may then determine at 590 whether the response has had an effect on the state of the occupant and/or environment of the crib. One or more of the steps shown in FIG. 5 may be associated with a time delay. For example, the processor may wait 30 seconds before making the determination at 590. During those 30 seconds, it may collect new sensor data and analyze the sensor data to determine whether the condition has changed.

A few specific examples regarding the sensors, entertainment device(s), interaction between the sensors and/or entertainment device(s), detection of conditions around and in the crib (or frame), and notices constructed in response thereto will be described. These examples merely describe specific implementations and are not limiting. One of ordinary skill in the art will recognize that a variety of different sensor data may be obtained and processed. Further, the sensors may communicate (bidirectionally or unidirectionally) with other devices and/or sensors not associated with the crib. The device handling the processing of the sensor data may be programmed to generate notices based on the variety of conditions detected by the sensors.

In an implementation, a camera may detect motion at a particular time and that there is an occupant of the crib (e.g., by a pressure sensor). The time may be preprogrammed by an end user. For example, an end user may configure the system to recognize that a nap time or nighttime sleep time for a baby or toddler is from 7:30 PM to 7:30 AM. If motion is detected by the camera in the interior of the crib between those hours and it is detected for period exceeding one minute, the processor may generate a notice such as a beep to be emitted by the client device and/or sending through the audio feed detect by the microphone in the crib. The recipient of the notice may provide instructions for how the crib may respond. For example, the recipient may activate speakers on the crib and speak to the child directly. The recipient may elect to have a pre-recorded message played, a video played, and/or have music or white noise played for a predetermined amount of time. In some configurations, the processor may receive an instruction from the client device indicating that the child is sleeping. For example, the user may place the child in the crib for a nap period at 1:00 PM. A button on the crib, for example, or the client device may be utilized to indicate to the crib that the child is sleeping. This may activate specific sensors and/or indicate to the processor to detect specific types of occupant behavior (e.g., search for when the child is awake based on motion detected for greater than 2 minutes or warn client device if child has not fallen asleep within 5 minutes of the sleep mode being activated).

In an implementation, a pressure sensor located on the top of one or more of the vertical surfaces of the crib may indicate the presence of the child's hands thereon. It may be associated with localized contacts on the first surface and the localized contacts may be intermittent. This may be interpreted as a child jumping up and down in the crib and/or standing in the crib. This information may be followed by a detected loss of the pressure on the first surface and subsequently a loss of the pressure on the top of the second surface combined with a "thud" being detected by a microphone. This may be determined by the processor to indicate that the child has escaped from the interior of the crib. A notice may be sent to the client device to that effect.

In an implementation, the pressure sensor on the horizontal support platform may be configured to indicate a child's weight to the client device. The user or owner of the client device may plot the child's weight over a specified period of time based on the measurements of the pressure sensor. A camera may perform a motion capture and detect an estimated size of the child based on the captured images. For example, the camera may collect a series of still images and estimate distances between a child's hand and elbow and/or a knee and a foot. The determined distances may be combined to compute an overall length of the child. An overall length may be computed based on a measurement from the top of the head to the base of the foot in some instances. As with weight, the length of the child may be plotted or otherwise viewed as a function of time (e.g., days, months, years, etc.). Other metrics, such as a child's sleeping health may be computed as well. For example, the processor may compute the sleep activity of the child such as the number of times the child turns over during sleep periods based on camera data, the number times the child is awake during sleep periods, the number of times the child cries or coughs during sleep periods, etc. A sleep period may refer to a nighttime period preconfigured by a user (e.g., between 7:30 PM and 7:30 AM), a manually entered sleep time (e.g., child taking a nap), and/or an automatically-detected sleep period (e.g., it is dark in the child's room, it is nighttime, and the child has been relatively motionless or in a sleep pattern for 5 minutes).

In an implementation, an air sensor may detect a dirty diaper or that an "accident" has occurred in the crib. It may notify the client device that the child and/or crib requires attention to change a diaper and/or sheets in the crib.

In an implementation, the crib may receive communications from a device other than the client device that indicates, for example, a fire or carbon monoxide. The crib may have preprogrammed responses such as to alert the client device of the received indication (e.g., that a fire alarm has been alerted). In some configurations, the sensors may detect the condition and alert the client device. For example, an abnormal ambient temperature reading by a temperature sensor may trigger a notice to be sent to the client device. As another example, a fire alarm may be emitting a beep or flash pattern. The parents of the child may not be aware of the fire alarm's signal. The sensors on the crib, however, may be configured to detect a pattern that suggests a fire alarm is active and a notice may be dispatched to the client device. The client device may send an instruction to the crib to activate a camera that has a panning capability. Thus, the parents of the child, for example, may be able to quickly scan the child's room and crib area to ensure the child is safe. In some configurations, the fire alarm may cause LEDs on the crib to illuminate and/or a pre-recorded voice to be played.

In some configurations, the sensor data obtained from the crib's sensors may augment a smart home system. For example, a sensor detecting a high level of carbon monoxide may not only alert the client device, but also a controller of a smart home system. In response to the notice, the smart home system may dispatch a notice to a third party (e.g., fire department) and/or other client devices associated with the controller (e.g., other occupants of the home who are not receiving notices from the crib).

The processor may be configured to determine or detect a pattern of behavior based on signals received from the one or more sensors over a period of time and/or instructions received from a client device. As a specific example, a sleep pattern may be learned based on a child's sleeping behavior for a week. The processor may determine that a child awakes at approximately 11:00 PM most nights. Initially, the system may alert the client device that the child is awake. It may receive instruction from the client device to emit a particular color pattern using LEDs (e.g., a deep purple color) and to play a heartbeat sound. It may detect that the child typically falls asleep within 2 minutes of carrying out the instructions received. At a subsequent point in time, if the child awakes at 11:00 PM, rather than contact the client device, the deep purple color and the heartbeat sound may be played by an entertainment device. In the event the child does not fall asleep as predicted, a notice may be dispatched to the client device. The notice may indicate that the crib's entertainment devices have already performed the usual procedure requested by the user but have not been successful in calming or quieting the child.

As another example, in the morning, the child may wake up usually at 6:00 AM and the client device may provide instruction to the crib to emit an orange LED color with some music played at a low volume level. Upon learning the client device's routine instructions for the time of day and detected event, the crib may automatically perform the requested feature. That is, it may have learned a client device's desired response to various events detected by the sensors.

A machine learning algorithm may be applied to the data generated or obtained from the sensors of the crib. For example, audio data obtained by a microphone may be analyzed for a child's crying. Different cries may be associated with different needs of the child. For example, one type of cry may be associated with hunger while another type of cry may be associated with a desire for a diaper change. By analyzing the length, volume, pitch, and/or frequency of crying patterns in combination with the time of day, the processor may determine a likely reason for a child's crying and alert the client device accordingly. In some configurations, a notice may be sent to the client device to inquire as to the nature of the crying and/or confirm the predicted type of crying. For example, the notice may ask the user to indicate whether the crying was due to hunger, diaper change, attention or soothing, or other need. In some instances, the type of crying may be ascertained by comparing the audio data representing the crying to that of known crying types and matching the obtained audio data for the cry to a best or closest matching known cry.

Thus, various patterns of behavior both for that of the child occupying the crib and/or the response of the user thereto may be analyzed to generate improved notices and/or to lessen the instances for which the client device needs to be disturbed. A deviation from a pattern of behavior may likewise be learned or detected. For example, a child may routinely go to sleep between 7:40 PM and 7:48 PM. However, on a particular night, the child may be coughing at 7:55 PM and otherwise determined to be awake by the system. A processor may detect the deviation from the usual behavior of sleeping and alert the client device.

According to an implementation, a child crib is disclosed that includes a first sensor integral with a horizontal support platform of the crib as disclosed in FIG. 1 and a second sensor that is integral with a portion of an enclosure of the crib. The enclosure may refer to the contained area above the horizontal support platform. As stated above, the entire perimeter of the crib need not have identical structure and there may be gaps in the enclosure, some of which may be large enough for a toddler to leave the crib of the toddler's own volition.

A sensor being integral or physical integrated with horizontal support platform and/or a vertical surface may refer to the sensor being embedded into the structure of the platform or surface as shown, for example, in FIG. 3. Other techniques may be utilized for embedding the sensor into the structure of the crib such as three-dimensional printing or creation of cavities in the structure and use thereof for sensors. A sensor may have suitable computer hardware and wires that are not exposed to the environment except for a finished face such as that shown in FIG. 3. As a specific example, a camera may have circuitry and hardware such as a light source, lens, a lens support structure, and a mechanism to adjust the focal point of the one or more lenses. The majority of the hardware and circuitry may be concealed inside the crib's structure (e.g., the platform and/or surface(s)). The outermost lens may be exposed to the environment and the camera may utilize a cover plate or the like to prevent tampering with its circuitry and/or hardware.

The child crib may include a wireless communication module that can communicate with a client device, a controller, and/or remote system as disclosed herein. The communication module may refer to a communication chipset that includes a radio antenna. The child crib may include a processor that can determine a condition of an occupant of the crib based upon data received from the first sensor, the second sensor, or both as described above. The processor may provide an indication of the condition to a remote device. For example, it may generate a notice that the child is awake.

Implementations disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an away (e.g., "armed") state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

An "away" mode for the home security system may be utilized, for example, when the occupants are away. In the away mode, the entry points into a home may be monitored for intrusion by an unwanted party. A "home" mode may refer to the home security system's state when the occupants are home. The mode can affect the actions taken by the security system in response to sensed activities in the home. For example, in home mode, the sensed opening of an exterior door may result in no action being taken by the security system. In the away mode, the sensed opening of the same door may be construed as an intrusion detection and may trigger a call to the police. There can also be an intermediate mode between stay and away. For example, there can be a "night" mode for when occupants are sleeping in the home. This mode can, for example, refrain from triggering an alert to the police based on sensed movement in the bedroom and hallways, but send such an alert when an exterior door is opened. The system can transition between modes when a user enters a security code into an entryway security system. Such modes apply to the security system for the whole home.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor, a sensor device, or a sensor package. For clarity, sensors are described with respect to the particular functions they perform and/or the particular physical hardware used, when such specification is necessary for understanding of the implementations disclosed herein.

Figure 7A:
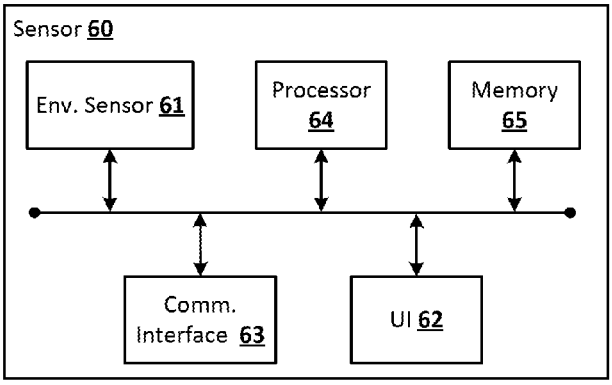
FIG. 7A shows an example sensor as disclosed herein.

A sensor may include hardware in addition to the specific physical sensor that obtains information about the environment. FIG. 7A shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a liquid crystal display (LCD), light-emitting diode (LED) display, or limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

In some configurations, two or more sensors may generate data that can be used by a processor of a system to generate a response and/or infer a state of the environment. For example, an ambient light sensor in a room may determine that the room is dark (e.g., less than 60 lux). A microphone in the room may detect a sound above a set threshold, such as 60 dB. The system processor may determine, based on the data generated by both sensors that it should activate one or more lights in the room. In the event the processor only received data from the ambient light sensor, the system may not have any basis to alter the state of the lighting in the room. Similarly, if the processor only received data from the microphone, the system may lack sufficient data to determine whether activating the lights in the room is necessary, for example, during the day the room may already be bright or during the night the lights may already be on. As another example, two or more sensors may communicate with one another. Thus, data generated by multiple sensors simultaneously or nearly simultaneously may be used to determine a state of an environment and, based on the determined state, generate a response.

Figure 8A:
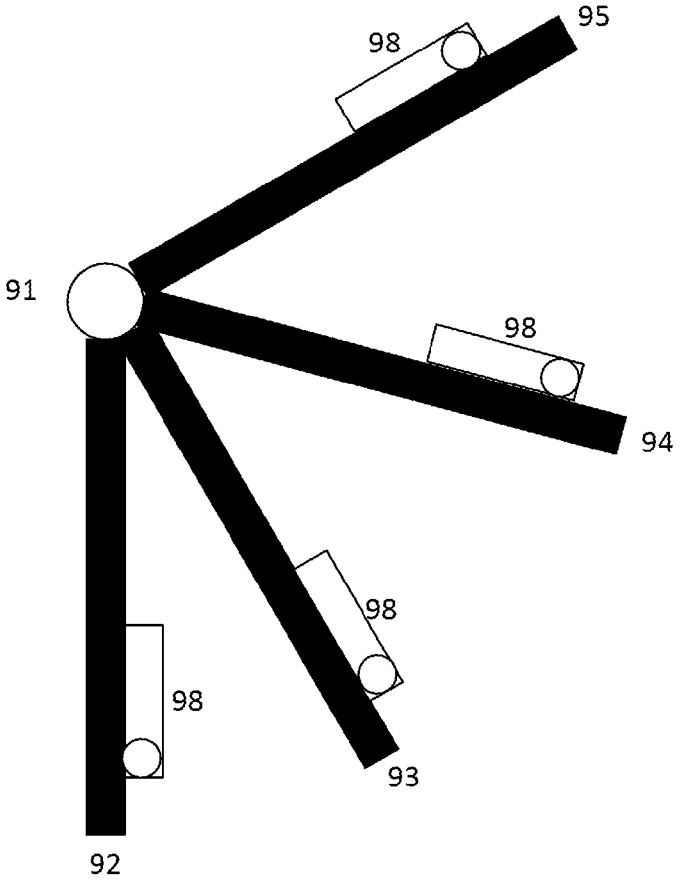
FIG. 8A shows a schematic representation of an example of a door that opens by a hinge mechanism as disclosed herein.

As another example, a security system may employ a magnetometer affixed to a doorjamb and a magnet affixed to the door. When the door is closed, the magnetometer may detect the magnetic field emanating from the magnet. If the door is opened, the increased distance may cause the magnetic field near the magnetometer to be too weak to be detected by the magnetometer. If the security system is activated, it may interpret such non-detection as the door being ajar or open. In some configurations, a separate sensor or a sensor integrated into one or more of the magnetometer and/or magnet may be incorporated to provide data regarding the status of the door. For example, an accelerometer and/or a compass may be affixed to the door and indicate the status of the door and/or augment the data provided by the magnetometer. FIG. 8A shows a schematic representation of an example of a door that opens by a hinge mechanism 91. In the first position 92, the door is closed and the compass 98 may indicate a first direction. The door may be opened at a variety of positions as shown 93, 94, 95. The fourth position 95 may represent the maximum amount the door can be opened. Based on the compass 98 readings, the position of the door may be determined and/or distinguished more specifically than merely open or closed. In the second position 93, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

Figure 8B:
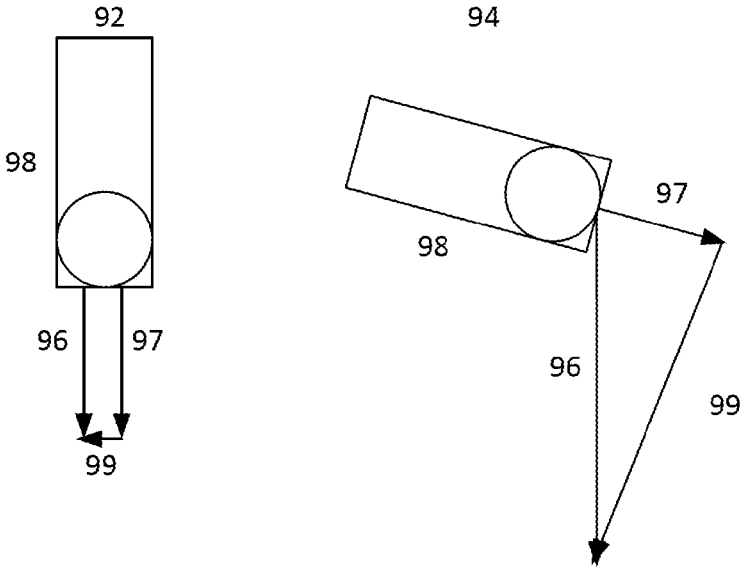
FIG. 8B shows a compass in two different positions that are illustrated in FIG. 8A, according to implementations disclosed herein.

FIG. 8B shows a compass 98 in two different positions, 92, 94, from FIG. 8A. In the first position 92, the compass detects a first direction 96. The compass's direction is indicated as 97 and it may be a known distance from a particular location. For example, when affixed to a door, the compass may automatically determine the distance from the doorjamb or a user may input a distance from the doorjamb. The distance representing how far away from the doorjamb the door is 99 may be computed by a variety of trigonometric formulas. In the first position 92, the door is indicated as not being separate from the doorjamb (i.e., closed) 99. Although features 96 and 97 are shown as distinct in FIG. 8B, they may overlap entirely. In the second position 94, the distance between the doorjamb and the door 99 may indicate that the door has been opened wide enough that a person may enter. Thus, the sensors may be integrated into a home security system, mesh network (e.g., Thread), or work in combination with other sensors positioned in and/or around an environment.

In some configurations, an accelerometer may be employed to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as previously described. The data may be analyzed to learn a user behavior, an environment state, and/or as a component of a home security or home automation system. While the above example is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, etc.

Data generated by one or more sensors may indicate a behavior pattern of one or more users and/or an environment state over time, and thus may be used to "learn" such characteristics. For example, data generated by an ambient light sensor in a room of a house and the time of day may be stored in a local or remote storage medium with the permission of an end user. A processor in communication with the storage medium may compute a behavior based on the data generated by the light sensor. The light sensor data may indicate that the amount of light detected increases until an approximate time or time period, such as 3:30 PM, and then declines until another approximate time or time period, such as 5:30 PM, at which point there is an abrupt increase in the amount of light detected. In many cases, the amount of light detected after the second time period may be either below a dark level of light (e.g., under or equal to 60 lux) or bright (e.g., equal to or above 400 lux). In this example, the data may indicate that after 5:30 PM, an occupant is turning on/off a light as the occupant of the room in which the sensor is located enters/leaves the room. At other times, the light sensor data may indicate that no lights are turned on/off in the room. The system, therefore, may learn that occupants patterns of turning on and off lights, and may generate a response to the learned behavior. For example, at 5:30 PM, a smart home environment or other sensor network may automatically activate the lights in the room if it detects an occupant in proximity to the home. In some implementations, such behavior patterns may be verified using other sensors. Continuing the example, user behavior regarding specific lights may be verified and/or further refined based upon states of, or data gathered by, smart switches, outlets, lamps, and the like.

Sensors as disclosed herein may operate within a communication network, such as a conventional wireless network, and/or a sensor-specific network through which sensors may communicate with one another and/or with dedicated other devices. In some configurations, one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 7B:
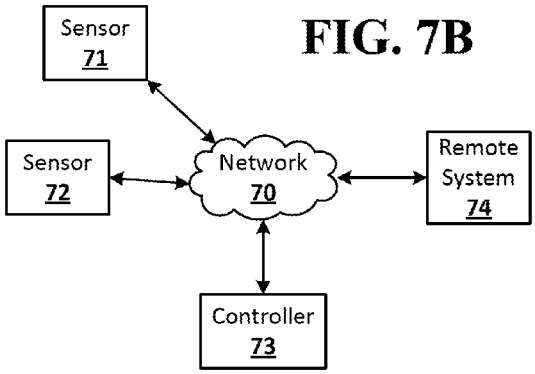
FIG. 7B shows an example of a sensor network as disclosed herein.

FIG. 7B shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer such as a smartphone, a smartwatch, a tablet, a laptop, etc. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. In some configurations, the system may have multiple controllers 74 such as where multiple occupants' smartphones and/or smartwatches are authorized to control and/or send/receive data to or from the various sensors 71, 72 deployed in the home. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail and prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 7B may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 7B may include a plurality of devices, including intelligent, multi-sensing, network-connected devices, that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 7B.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 7B, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 7B, and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some implementations, the smart-home environment of the sensor network shown in FIG. 7B may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 7B. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjust the power and/or speed of the fan, accordingly. Smart wall plugs may control supply of power to one or more wall plugs (e.g., such that power is not supplied to the plug if nobody is detected to be within the smart-home environment). For example, one of the smart wall plugs may control supply of power to a lamp (not shown).

In implementations of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 7B. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some implementations of the disclosed subject matter, the alarm system, which may be included with controller 73 and/or coupled to the network 70 may not be placed in an away mode (e.g., "armed") unless all smart entry detectors (e.g., sensors 71, 72) indicate that all doors, windows, entryways, and the like are closed and/or that all smart entry detectors are in an away mode. In some configurations, such as the door example shown in FIGS. 8A and 8B, the system may arm if it can be determined that the distance the door (or window) is ajar is insubstantial (e.g., the opening is not wide enough for a person to fit through).

The smart-home environment of the sensor network shown in FIG. 7B can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 7B) can be communicatively coupled to each other via the network 70, and to the controller 73 and/or remote system 74 to provide security, safety, and/or comfort for the smart home environment.

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, or the like). A webpage or application can be configured to receive communications from the user and control the one or more of the network-connected smart devices based on the communications and/or to present information about the device's operation to the user. For example, the user can view or change the mode of the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some implementations including sensors used by or within the smart-home environment.

Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event that any of the network-connected smart devices, such as smart wall plugs located outdoors, detect movement at nighttime, the controller 73 and/or remote system 74 can activate the outdoor lighting system and/or other lights in the smart-home environment.

Figure 7C:
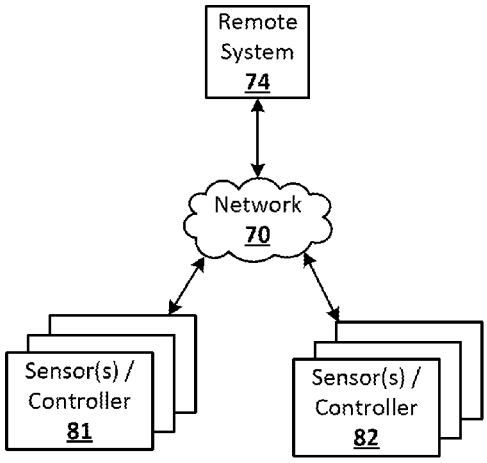
FIG. 7C shows an example configuration of sensors, one or more controllers, and a remote system as disclosed herein.

In some configurations, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIG. 7B may provide information to the remote system 74 as shown in FIG. 7C. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. As another example, systems disclosed herein may allow a user to restrict the information collected by the systems disclosed herein to applications specific to the user, such as by disabling or limiting the extent to which such information is aggregated or used in analysis with other information from other users. Thus, the user may have control over how information is collected about the user and used by a system as disclosed herein.

Figure 6A:
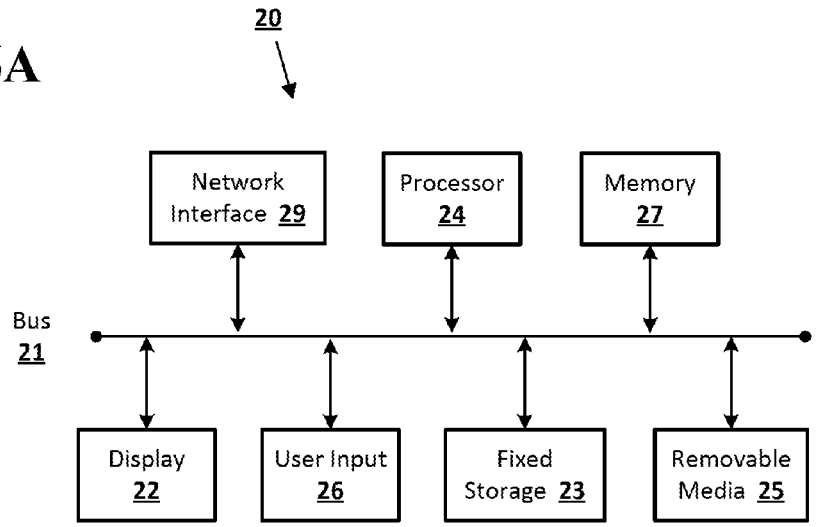
FIG. 6A shows a computer according to an implementation of the disclosed subject matter.

Implementations of the presently disclosed subject matter may be implemented in and used with a variety of component and network architectures. FIG. 6A is an example computer 20 suitable for implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection, or the like. For example, the network interface 29 may allow the computer to communicate with other computers via one or more local, wide-area, or other networks, as shown in FIG. 6B.

Many other devices or components (not shown) may be connected in a similar manner (e.g., document scanners, digital cameras, and so on). Conversely, all of the components shown in FIG. 6A need not be present to practice the present disclosure. The components can be interconnected in different ways from that shown. The operation of a computer such as that shown in FIG. 6A is readily known in the art and is not discussed in detail in this application. Code to implement the present disclosure can be stored in computer-readable storage media such as one or more of the memory 27, fixed storage 23, removable media 25, or on a remote storage location.

Figure 6B:
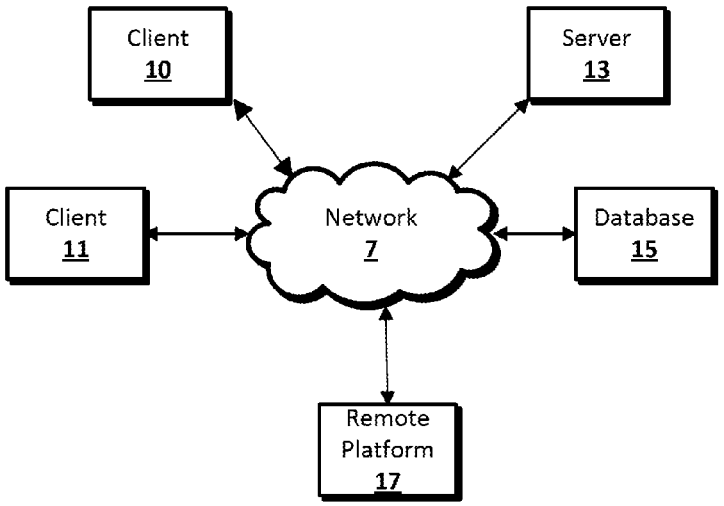
FIG. 6B shows a network configuration according to an implementation of the disclosed subject matter.

FIG. 6B shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. The disclosed subject matter also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions.

Implementations may use hardware that includes a processor, such as a general-purpose microprocessor and/or an Application Specific Integrated Circuit (ASIC) that includes all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A bed, comprising:

a support platform of the bed;

a plurality of surfaces connected to the support platform and arranged to form a contained space above the support platform;

a sensor integral with at least one of the support platform or at least one of the plurality of surfaces;

a processor integral with the at least one of the support platform or the at least one of the plurality of surfaces, the processor configured to determine a condition of an occupant of the contained space in response to a signal received from the sensor, and to determine an action to be performed by the bed in response to the condition;

a microphone; and an entertainment device integral with the at least one of the support platform or the at least one of the plurality of surfaces, wherein the action to be performed by the bed comprises a noise to be produced by the entertainment device, and the processor is further configured to receive data from the microphone, to determine, from the data, an ambient level of sound, and to adjust a characteristic of the noise in response to the ambient level of sound.

2. A bed, comprising:

a support platform of the bed;

a plurality of surfaces connected to the support platform and arranged to form a contained space above the support platform;

a sensor integral with at least one of the support platform or at least one of the plurality of surfaces;

a processor integral with the at least one of the support platform or the at least one of the plurality of surfaces, the processor configured to determine a condition of an occupant of the contained space in response to a signal received from the sensor, and to determine an action to be performed by the bed in response to the condition, wherein the action to be performed by the bed has a measurable characteristic, and the processor is further configured to adjust at least one of a magnitude of the characteristic in response to a measure of time associated with the occupant or a frequency at which the action is performed in response to the measure of time associated with the occupant.

3. A bed, comprising:

a support platform of the bed;

a plurality of surfaces connected to the support platform and arranged to form a contained space above the support platform;

a sensor integral with at least one of the support platform or at least one of the plurality of surfaces;

a processor integral with the at least one of the support platform or the at least one of the plurality of surfaces, the processor configured to determine a condition of an occupant of the contained space in response to a signal received from the sensor, and to determine an action to be performed by the bed in response to the condition; and a communication device integral with the at least one of the support platform or the at least one of the plurality of surfaces, the communication device configured to receive a message from a client device, the processor further configured determine the action to be performed by the bed in response to the message, the client device being a portable electronic telecommunication device.

4. A bed, comprising:

a support platform of the bed;

a plurality of surfaces connected to the support platform and arranged to form a contained space above the support platform;

a sensor integral with at least one of the support platform or at least one of the plurality of surfaces, wherein the sensor comprises a pressure sensor and a motion sensor; and a processor integral with the at least one of the support platform or the at least one of the plurality of surfaces, the processor configured to determine a condition of an occupant of the contained space in response to a signal received from the sensor, and to determine an action to be performed by the bed in response to the condition.

5. The bed of claim 4, wherein the bed comprises a crib.

6. The bed of claim 4, further comprising a microphone, wherein the processor is further configured to receive data from the microphone and to determine, from the data, that the occupant is crying.

7. The bed of claim 4, wherein the processor is configured to determine, in response to the signals including a signal from the pressure sensor that is indicative of two distinct pressure points, the state of the occupant to be a state of standing.

8. The bed of claim 7, wherein the processor is configured to determine, in response to the signal from the pressure sensor being indicative of an area of pressure larger than the two distinct pressure points, the state of the occupant to be a state of sleeping.

9. The bed of claim 8, wherein the processor is configured to determine, in response to the signals including a signal from the motion sensor that is indicative of motions by the occupant, the state of sleeping to be a restless form of sleep.

10. The bed of claim 4, wherein the support platform having a first end and a second end, and further comprising a motorized mechanism configured to control a height of the first end with respect to the second end.

11. The bed of claim 4, wherein a height of at least one of the plurality of surfaces is adjustable.

12. A bed, comprising:

a support platform of the bed;

a plurality of surfaces connected to the support platform and arranged to form a contained space above the support platform;

a sensor integral with at least one of the support platform or at least one of the plurality of surfaces;

a processor integral with the at least one of the support platform or the at least one of the plurality of surfaces, the processor configured to determine a condition of an occupant of the contained space in response to a signal received from the sensor, and to determine an action to be performed by the bed in response to the condition; and a communication device integral with the at least one of the support platform or the at least one of the plurality of surfaces, the communication device configured to communicate, in response to the sensor having sensed that the occupant of the contained space is awake, a message to a client device being a portable electronic telecommunication device.

13. A bed, comprising:

a support platform of the bed;

a plurality of surfaces connected to the support platform and arranged to form a contained space above the support platform;

a sensor integral with at least one of the support platform or at least one of the plurality of surfaces;

a processor integral with the at least one of the support platform or the at least one of the plurality of surfaces, the processor configured to determine a condition of an occupant of the contained space in response to a signal received from the sensor, and to determine an action to be performed by the bed in response to the condition; and a shield configured to shield the occupant of the contained space from an electromagnetic radiation, wherein the shield extends over at least a portion of the support platform or a portion of at least one of the plurality of surfaces.

14. The bed of claim 13, wherein the shield is configured to shield the contained space from the electromagnetic radiation produced by at least one of a communication device integral with at least one of the support platform or the at least one of the plurality of surfaces, the sensor integral with the at least one of the support platform or the at least one of the plurality of surfaces, the processor integral with the at least one of the support platform or the at least one of the plurality of surfaces, or a power connector for an electronic device for the bed.

15. The bed of claim 13, wherein the shield covers at least a portion of at least one of the support platform or the at least one of the plurality of surfaces.

16. A bed, comprising:

a support platform of the bed;

a plurality of surfaces connected to the support platform and arranged to form a contained space above the support platform;

a sensor integral with at least one of the support platform or at least one of the plurality of surfaces; and a processor integral with the at least one of the support platform or the at least one of the plurality of surfaces, the processor configured to determine a condition of an occupant of the contained space in response to a signal received from the sensor, and to determine an action to be performed by the bed in response to the condition;

wherein the support platform has a least one spring and the sensor is connected to at least one of the at least one spring.

17. A bed, comprising:

a support platform of the bed;

a plurality of surfaces connected to the support platform and arranged to form a contained space above the support platform;

a sensor integral with at least one of the support platform or at least one of the plurality of surfaces; and a processor integral with the at least one of the support platform or the at least one of the plurality of surfaces, the processor configured to determine a condition of an occupant of the contained space in response to a signal received from the sensor, and to determine an action to be performed by the bed in response to the condition;

wherein the at least one of the plurality of surfaces has a door, the sensor is configured to detect an environmental condition, and the processor comprises a controller configured to unlatch the door in response to a signal received from the sensor.

18. A bed comprising:

a support platform of the bed;

a plurality of surfaces connected to the support platform and arranged to form a contained space above the support platform;

a sensor integral with at least one of the support platform or at least one of the plurality of surfaces;

a local storage medium configured to store information that represents a sleeping pattern of an occupant of the contained space; and a processor integral with the at least one of the support platform or the at least one of the plurality of surfaces, the processor configured to learn the sleeping pattern of the occupant, to store the sleeping pattern in the local storage medium, to determine a condition of the occupant in response to a signal received from the sensor, to analyze, in response to the sensor having sensed motions of the occupant, the sleeping pattern, and to determine an action to be performed by the bed in response to the condition.

19. A bed, comprising:

a support platform of the bed;

a plurality of surfaces connected to the support platform and arranged to form a contained space above the support platform;

a sensor disposed at a first position integral with at least one of the support platform or the at least one of the plurality of surfaces; and an entertainment device disposed at a second position integral with the at least one of the support platform or the at least one of the plurality of surfaces, wherein each of the sensor and the entertainment device has a predetermined size and shape so that the sensor is capable of being disposed at the second position and the entertainment device is capable of being disposed at the first position.

20. The bed of claim 19, wherein the entertainment device includes at least one light.

21. A bed, comprising:

a first sensor integral with a support platform of the bed at a first position; and a second sensor integral with a portion of an enclosure of the bed at a second position, wherein each of the first sensor and the second sensor has a predetermined size and shape so that the first sensor is capable of being disposed at the second position and the second sensor is capable of being disposed at the first position.

22. The bed of claim 21, wherein a configuration of a power connector of the first sensor is identical to a configuration of a power connector of the second sensor.

23. The bed of claim 21, wherein at least one of the first sensor or the second sensor is configured to communicate with another of the at least one of the first sensor or the second sensor.

* * * * *